United States Patent [19]

Maniá

[11] 4,029,232

[45] June 14, 1977

[54] SINGLE-PIECE ALUMINIUM CONTAINER FOR AEROSOLS

[75] Inventor: Carlo Maniá, Milan, Italy

[73] Assignee: Broggi-Izar Fabbriche Italiane Riunite S.p.A., Milan, Italy

[22] Filed: Nov. 18, 1975

[21] Appl. No.: 632,895

[30] Foreign Application Priority Data

Nov. 25, 1974 Italy ..... 29782/74

[52] U.S. Cl. ..... 220/73; 220/66

[51] Int. Cl.[2] ..... B65D 7/42

[58] Field of Search ..... 220/73, 66, 71, 74, 220/66

[56] References Cited

UNITED STATES PATENTS

| | | | |
|---|---|---|---|
| 2,081,925 | 6/1937 | Graf | 220/71 X |
| 2,484,271 | 10/1949 | Coyle | 220/73 |
| 3,679,091 | 7/1972 | Krupp et al. | 220/74 X |

*Primary Examiner*—William Price
*Assistant Examiner*—Steven M. Pollard
*Attorney, Agent, or Firm*—Cushman, Darby & Cushman

[57] ABSTRACT

To reduce the mechanical stresses in the curled area of the mouth of an aerosol container (made of aluminium), a reinforcing ring, having either a closed loop or an open structure, is inserted so as to be completely encircled by the curled portion of the container mouth. In addition, a roughly arcuate seat can be formed on the collar area of the container mouth so as to provide a rather snug fit for the reinforcing ring once the curling has been completed.

5 Claims, 3 Drawing Figures

SINGLE-PIECE ALUMINIUM CONTAINER FOR AEROSOLS

This invention relates to the single-piece aluminum containers for aerosols and more particularly to the mouths of said containers as intended to receive the dispensing valve.

As is known, the mouths of such containers have generally an inside diameter of one inch (mm.25.4) as corresponding to the standard diameter of the dispensing valves.

Usually the container mouths are formed by curling the container edge towards the outside of the mouth, although mouths having inwardly curled edges have been suggested.

In the single-piece aerosol bottles, the mouth follows a crowned and tapered section through which the bottle body is radiussed to the mouth. Aerosol bottles are produced in a wide diameter range which at present is from 35 millimeters to 80 millimeters, whereas the inside diameter of the mouth, in view of the standardization of the dispensing valves, must be always 25.4 millimeters. Thus, consistently with the bottle size, it becomes necessary to impart to the container diameter different degrees of tapering so that also considerable differences in the thickness of the edge area are experienced between large and small containers, the edge area being intended to be curled to provide the container mouth. Inasmuch as, as it is apparent, the force for making the curl is the greater, the larger is the thickness of the material to be curled, especially for large-diameter bottles, it is already customary to reduce the thickness of the collar-like area involved in the subsequent curling stage by a turning operation. Such a turning operation has been carried out hitherto in a somewhat "rule of thumb" way.

The mouth of the single-piece aerosol containers is the portion of the container which can be regarded as the most sensitive one. As a matter of fact, on the one hand, in this portion of the mouth, upon application of the dispensing valve, there must be provided an actually hermetic seal against leakages of gases as container in the bottle under a high pressure while ensuring a thorough protective action against the corrosion by the products held in the bottle, and, on the other hand, the mouth area is subjected to high mechanical stresses as the dispensing valve is sealed to the container by pinching it with expansion pincers.

It is known that the tapering operations of the cylindrical container and mouth finishing can be carried out after that the inner protective coating has been applied and possibly also the outer enamelling and decoration on the container, but, in view of the high stresses to which the mouth area is subjected during its shaping, first and then during the sealing of the valve, it is sometimes preferred to machine the mouth surface intended to contact the valve gasket so as to remove the defective paint and scraping the surface or to form a circular groove with a properly shaped tool so as to provide a seal capable of providing a reliable sealtightness for the valve gasket.

It clearly stems from the foregoing that the mouth area of the single-piece containers for aerosols should be capable of withstanding very strong mechanical stresses while, concurrently, it should be made very accurately to prevent detrimental gas leaks and to provide a very reliable protection against corrosion.

It has been ascertained that the mouths as made heretofore do not fulfil these requirements in a thorough manner and difficulties have been experienced in carrying out an even machining of the mouth zone, and precisely its circular curl, for the entire range of the containers up to now available. The circular curl as conventionally formed on the single-piece aluminum containers has proven to be inadequately resistant and there is often the defect of a poor gas tightness in the sealed containers.

An object of this invention is thus to do away with these drawbacks while providing a mouth for a single-piece aluminum container which has a stronger mechanical resistance and an equal shape for all the range of containers to be produced and which can be shaped with a lesser power expenditure without resorting to lubricants.

Having this object in view the invention provides for the introduction of a reinforcing ring inside the mouth curl so as to prevent any deformation of the curled area while providing same with the necessary robustness and reliability as to the standardized shape and size to withstand the forces acting during the sealing of the dispensing valve to the container.

Such a ring is applied by slipping it onto the collar area of the container prior to carrying out the curling stage of the collar area itself. By subsequently curling the collar zone about the ring, the latter is firmly latched in the curl interior.

The reinforcing ring according to the invention can be made of any appropriate material, either metallic or nonmetallic. Stainless steel, aluminum or other lightweight alloys can be used for the ring, but also rings of plastics material can be used, for instance. The ring can make up a closed loop or also can it be open to provide a certain resiliency. It is an asset if the collar area of the single piece container which has already undergone the tapering operation is subjected to a turning operation on its outer side and that such a turning operation is carried out with a tool which is adapted to form in correspondence with the bottom portion of the collar area, that is where it is radiussed to the container crown, a seat intended accurately to receive, and even somewhat snugly in the radial direction, the reinforcing ring. By so doing, not only a faultless and even position of the ring is obtained, but the collar area is brought, as regards its outside shape, in the same conditions irrespective of the container size. For example, the thickness of the collar area is preferably brought to about 0.5 millimeter, that which permits the subsequent formation of the curl by the agency of conventional flaring tools acting by nonrotary axial pressure or rotary pressure and with a comparatively weak force without requiring any lubricant as a rule.

It has been seen that a mouth made according to the present invention affords a mechanical resistance which is at least the same as that of the solid curls of the two-piece aluminum bottles. The mouth, then, has always the same shape irrespective of the container size and, inasmuch as it is never deformed when the dispensing valve is sealed thereto, affords a fully reliable tight seal without any hazard of gas leaks from any sealed container.

The accompanying drawing shows in more detail the invention, namely:

Figure 1:
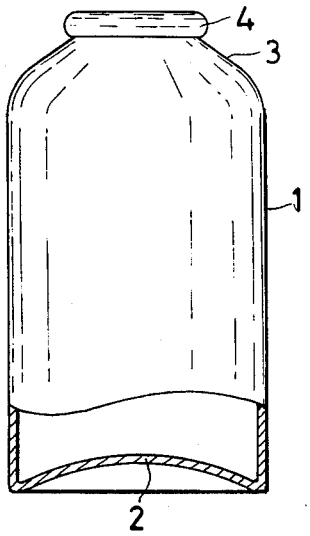
FIG. 1 is an overall elevational view of a single-piece aluminum bottle for aerosols, without the dispensing valve.

The container shown in FIG. 1 is constituted by the body 1 with the bottom wall 2, the "crown" 3 and the mouth 4.

Figure 2:
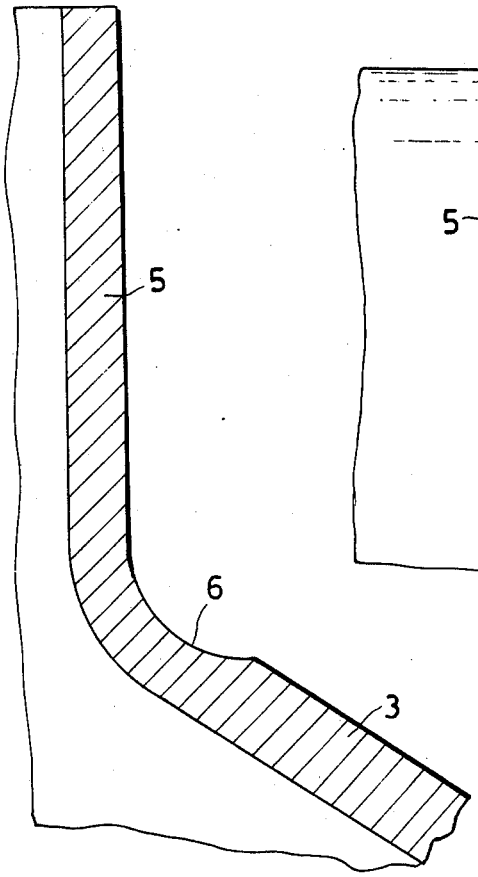
FIG. 2 is a cross-sectional view of the upper collar area of the container prior to curling.

As can be seen in FIG. 2, the collar zone 5 of the container, as it appears after tapering to obtain the crown 3 has a thinned out thickness in correspondence with its outer surface and down to its termination so as to provide a seat 6 intended to receive the reinforcing ring 7 (see FIG. 3) which thus is accurately housed, and preferably a shade snugly in the radial direction, in said seating.

Figure 3:
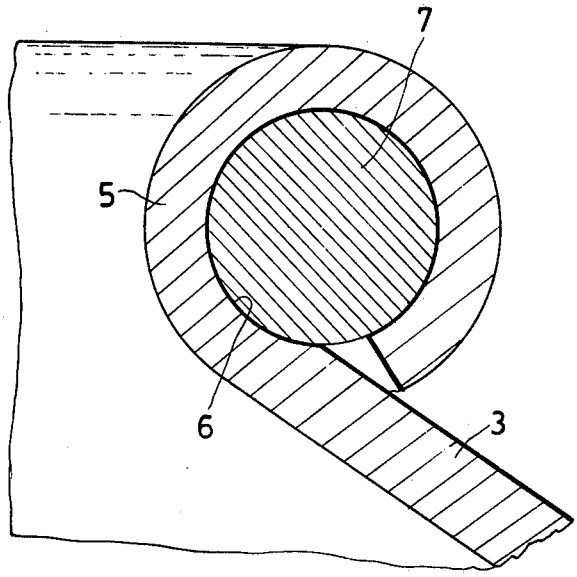
FIG. 3 is a cross-sectional view of the mouth with the curl containing the reinforcing ring.

FIG. 3 shows the finished mouth upon curling the collar zone 5 around the reinforcing ring 7.

Needless to say, the top portion of the finished mouth can be conventionally subjected to a scraping operation so as to remove the possible residue of tarnished varnish.

I claim:

1. In a single-piece aluminum container for aerosols having a body and a mouth formed by curling the container edge the improved mouth construction wherein the edge is curled around and in contact with a reinforcing ring and wherein the thickness of the curled edge is less than the thickness of the adjoining metal.

2. A container as in claim 1 wherein the reinforcing ring is metal.

3. A container as in claim 1 wherein the reinforcing ring is plastics material.

4. A container as in claim 1 wherein the reinforcing ring is a closed loop.

5. A container as in claim 1 wherein the reinforcing ring is an open loop.

* * * * *